US007419011B2

(12) United States Patent
Curtis et al.

(10) Patent No.: US 7,419,011 B2
(45) Date of Patent: Sep. 2, 2008

(54) ELECTRO-MECHANICAL POWER ANGLE SNOW PLOW

(75) Inventors: Marc D. Curtis, Spencer, MA (US); Kenneth Ehn, Leicester, MA (US)

(73) Assignee: Curtis International, Inc., Worcester, MA (US)

( * ) Notice: Subject to any disclaimer, the term of this patent is extended or adjusted under 35 U.S.C. 154(b) by 321 days.

(21) Appl. No.: 11/104,369

(22) Filed: Apr. 12, 2005

(65) Prior Publication Data

US 2006/0005433 A1 Jan. 12, 2006

Related U.S. Application Data

(60) Provisional application No. 60/567,475, filed on May 3, 2004, provisional application No. 60/577,302, filed on Jun. 4, 2004.

(51) Int. Cl.
*E02F 3/84* (2006.01)

(52) U.S. Cl. ..... 172/820; 172/819; 37/266

(58) Field of Classification Search ..... 172/818, 172/819, 820; 37/234, 235, 264, 266
See application file for complete search history.

(56) References Cited

U.S. PATENT DOCUMENTS 621,935 A * 3/1899 McCusker ..... 37/225
1,195,271 A * 8/1916 Ruth ..... 37/232
2,488,016 A * 11/1949 Lado ..... 172/785
2,629,946 A * 2/1953 Ewers et al. ..... 172/817
2,775,830 A * 1/1957 Kenyon ..... 37/232
2,792,650 A * 5/1957 Kenyon ..... 37/234
2,854,766 A * 10/1958 Miller ..... 37/283
3,012,345 A * 12/1961 Krueger ..... 37/273
4,324,055 A * 4/1982 Hippensteel et al. ..... 37/283
4,821,436 A * 4/1989 Slocum ..... 37/235
5,088,215 A * 2/1992 Ciula ..... 37/197
6,145,222 A 11/2000 Curtis ..... 37/231
6,209,231 B1 4/2001 Curtis ..... 37/231
6,408,546 B2 6/2002 Curtis ..... 37/231
6,594,924 B2 7/2003 Curtis ..... 37/231
6,843,002 B1 * 1/2005 Moffitt ..... 37/231
6,957,505 B1 * 10/2005 Moffitt ..... 37/231

* cited by examiner

*Primary Examiner*—Gary Hartmann
(74) *Attorney, Agent, or Firm*—Nields & Lemack

(57) ABSTRACT

The present invention provides a small electrical motor, coupled to the snow plow of a UTV or ATV via a mechanism which allows the plow blade to move in response to unexpected spikes in load. In one embodiment, a braking system is used to absorb the load force. In a second embodiment, a set of pulleys is used in conjunction with a belt, such that the belt will slip in the presence of excessive force. In a third embodiment, a rack and pinion mechanism is used in combination with a spring element to absorb the excessive load.

6 Claims, 6 Drawing Sheets

ELECTRO-MECHANICAL POWER ANGLE SNOW PLOW

This application claims priority of Provisional Application Ser. No. 60/567,475 filed on May 3, 2004, and of Provisional Application Ser. No. 60/577,302, filed Jun. 4, 2004, the disclosures of which are hereby incorporated by reference.

BACKGROUND OF THE INVENTION

Conventionally, pickup trucks have been used to serve many functions, such as carrying cargo, pulling heavy loads, and plowing snow. While these trucks are versatile and can handle a large number of heavy-duty tasks, they are not without their disadvantages. In some instances, the truck may be physically too large for the area in which it is intended, such as the inside of a warehouse. These pickup trucks also tend to be expensive. For those applications where the functionality of a light-duty pickup is required, but the cost makes them impractical, many are looking to new categories of vehicles. In certain situations, professional grade All Terrain Vehicles (ATVs) are employed. For example, the bed of an ATV can be loaded with cinder blocks for transportation to the location at a building site where they are needed. Another class of vehicles has also emerged, known as Utility Vehicles (UTVs), which are larger than traditional ATVs, but still much smaller than pickup trucks. These vehicles are intended for towing, carrying cargo and plowing, although they do not have the power capabilities of the larger trucks. UTVs are typically used by golf courses, refineries, utilities, municipalities, and construction companies.

While utilitarian, there are disadvantages in using either ATVs or UTVs. Specifically, these vehicles have far less power than ordinary pickup trucks. For example, the engine of an exemplary UTV delivers 30 horsepower, as compared to over 200 HP for a typical pickup truck, limiting the UTVs to lower maximum payloads and lower towing capacities. The electrical systems of UTVs and ATVs are also inferior in terms of power capability. The alternator of a typically pickup truck is capable of delivering 130 amps, allowing it to supply energy to high-power external attachments, such as winches, hydraulic snow plows, and the like. However, the alternators for traditional ATVs and UTVs are capable of delivering only about 15-40 amps. This difference in electrical power restricts the usage of these high-power attachments on smaller vehicles. For example, the snow plows on a pickup truck are typically controlled via hydraulic cylinders, allowing the operator to move the blade from left to right, as well as elevate it. The motors used in these plow systems typically draw in excess of 100 Amps while the plow blade is being positioned. While the alternator in a typically pickup truck can readily supply this power, this energy load would quickly drain the battery and electrical system of the smaller ATVs and UTVs.

More importantly, cost is a major consideration for any attachment that is to be used with an ATV or UTV. These vehicles cost significantly less than a conventional truck. Therefore, it is impractical for the accessories for an ATV to be as expensive as those for a truck. Specifically, hydraulic systems, such as those used for powered snow plow blade, while acceptable for use with conventional trucks, are far too expensive to use with a much lower priced vehicle. Consequently, most accessories that are currently available for these smaller vehicles are controlled manually, thereby removing a significant source of cost.

Hydraulic systems have traditionally been used for snow plows for several reasons. First, the hydraulic pressure system is capable of lifting and moving the heavy weight of the plow.

Second, once the plow blade has been adjusted into position, the system uses minimal power to hold it in place, since the fluid pressure in the pistons helps to hold the blade in place. Lastly, hydraulic systems are able to adapt to unexpected spikes in load. Assume, for example, a snow plow blade has been set into position, and the left side of the blade encounters an excessive load, such as a curb or large rock. This load compresses the fluid in the piston that is holding the left side of the blade in place. Once that load exceeds a threshold value, the fluid will be forced out of the piston and back into the reservoir. This removal of fluid from the left piston allows the plow blade to turn toward the excessive load, without damage to the rest of the system. Without such a mechanism, plow systems would be seriously damaged whenever a curb, pothole, or other stationary object is encountered.

The low output power of UTVs and ATVs makes hydraulic systems impractical. Furthermore, the cost of a hydraulic system is a far higher percentage of the cost of the vehicle, which makes their use in this application impractical. Consequently, the snow plow systems used for most small vehicles, such as ATVs and UTVs, are manual, requiring the operator to manually lift and adjust the position of the blade, typically by using a bolt to set the proper angle and height of the blade. To address the issue of excessive loads, many manufacturers use pins or bolts purposely designed to shear off when they encounter too much force.

As ATVs and UTVs become more popular, it is desirable to be able to offer plow functionality similar to that available for conventional pickup trucks, while being mindful of the lower power and cost parameters associated with these vehicles.

It is therefore an object of the present invention to allow these vehicles, despite their lower electrical output, to be equipped with fully powered snow plows, capable of having their blade angle remotely adjusted. It is a further object of the present invention to allow this powered system to be able to withstand unexpected excessive spikes in load, caused by unseen or unexpected objects that may be encountered.

SUMMARY OF THE INVENTION

The problems of the prior art have been overcome by the present invention, which provides a small electrical motor, coupled to a snow plow via a mechanism which allows the plow blade to move in response to unexpected spikes in load. In one embodiment, a braking system is used to absorb the load force. In a second embodiment, a set of pulleys is used in conjunction with a belt, such that the belt will slip in the presence of excessive force. In a third embodiment, a rack and pinion mechanism is used in combination with a spring element to absorb the excessive load.

DETAILED DESCRIPTION OF THE INVENTION

Figure 1:
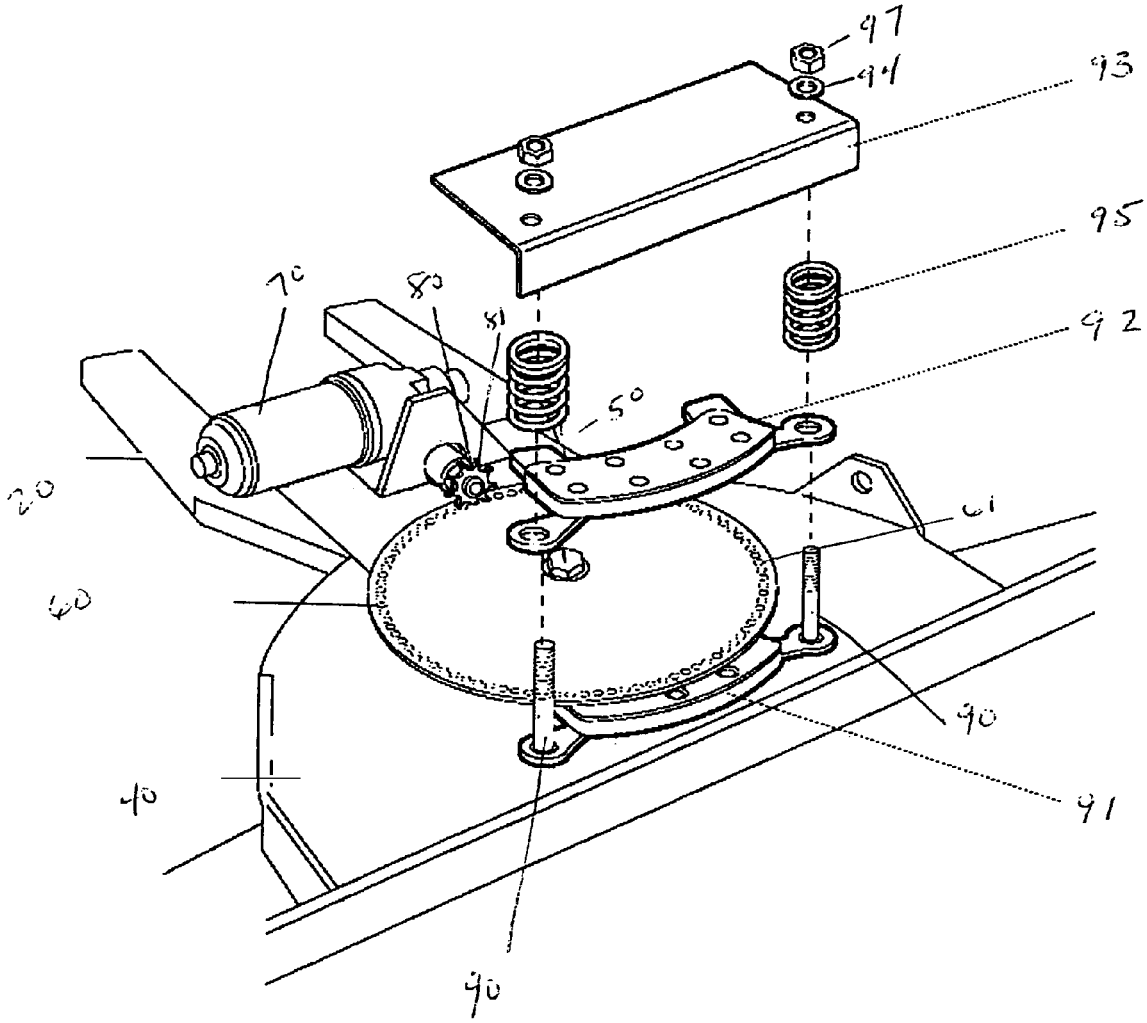
FIG. 1 is a top view of a first embodiment of the electrically powered snow blade in accordance with the present invention.

Turning first to FIG. 1, there is shown generally a snow blade assembly that is suitable for use in an ATV or other small vehicle. Those skilled in the art will appreciate that the assembly shown is for purposes of illustration, and that the invention is not limited to any particular assembly.

The snow blade (not shown) is shaped like a traditional blade found on any of a variety of trucks. However, due to the smaller size of the ATV or UTV onto which it is mounted, the blade is typically much smaller in length than a conventional snowplow, typically in the range of 36-60 inches. This reduced length also significantly reduces the weight of the blade. Materials of construction of the blade are not particularly limited; the blade may be formed of a sheet of steel bumped or rolled to a semi-round shape and optionally braced on the backside with a plurality of vertical ribs and horizontal members. Lighter weight materials such as plastics and composites also may be used provided they meet the rigidity and durability requirements for plowing.

Support 40 can be an integral part of the blade, or can be attached to the blade such as by welding. Support 40 is pivotally attached to frame 20 at point 50, such as to allow support 40 to move rotationally about a vertical axis through point 50. The opposite end of frame 20 is then attached to the vehicle, either directly or using one of many attachment methods. Those skilled in the art are aware of numerous mechanisms which allow the attachment of the frame to the vehicle, including that taught by U.S. Pat. No. 6,594,924, issued to Curtis International, the disclosure of which is hereby incorporated by reference.

Located on support 40, with its center aligned with point 50, is circular plate 60. Associated with the plate 60 is an electrical motor 70, which in the embodiment shown, is supported by frame 20. Electrical motor 70 is preferably a small winch motor or can be similar to that used to actuator the windshield wipers of an automobile. Electric motor 70 is reversible and has a drive shaft in communication with sprocket 80. The sprocket 80 is capable of turning in both the clockwise and counterclockwise direction, when an appropriate power signal is applied to it, but is fixed in the linear and radial directions. Circular plate 60 has a pattern of holes 61 which are designed to correspond with the teeth 81 in sprocket 80. At any given time, certain of the teeth 81 of sprocket 80 are engaged in certain of the holes 61 in circular plate 60, which preferably are located near its outer diameter. Thus, clockwise movement of the sprocket causes a counterclockwise movement of circular plate 60, as the teeth 81 engage with the holes 61 in the circular plate 60. Conversely, a counterclockwise movement of the sprocket causes a clockwise movement of the circular plate. Those skilled in the art will appreciate that the sprocket and holes mechanism shown is for purposes of illustration, and that the invention is not so limited. For example, interlocking gear teeth or a worm gear could be used instead of the sprocket and holes combination.

Attached to the support 40 are multiple, preferably two, positioning rods 90, preferably bolts. A first brake shoe 91 is mounted on support 40, with positioning rods 90 passing through openings in the first brake shoe 91. A second brake shoe 92 is affixed in a like manner, with circular plate 60 sandwiched between the two brake shoes. At least one compressible or biasing member 95, preferably a spring, is placed atop the second brake shoe 92, preferably on positioning rods 90. Preferably two biasing members 95 are used as shown. A plate 93 is mounted on compressible member(s) 95, with positioning rods 90 passing through openings in the plate 93. The combination of plate 93, compressible member(s) 95, brake shoe 92, circular plate 60 and brake shoe 91 are maintained under compression. In the preferred embodiment, washers 94 are placed on top of the plate 93, on positioning rods 90. Lastly, fastening devices 97, preferably bolts, are affixed to the positioning rods and tightened so as to create compression, and therefore create friction between the brake shoes and the circular plate 60.

The friction between the brake shoes 91 and 92, and the circular plate 60, is sufficient to hold the circular plate in a fixed position relative to the brake shoes under most circumstances. However, if the plow blade encounters an excessive load sufficient to overcome the bias of the spring member(s) 95 and therefore the compression of the plate 61, the support 40, and the brake shoes 91 and 92, will move relative to the circular plate. This insures that the impact of the excessive load is not transferred back to the nexus of the sprocket teeth and the holes of the circular plate, where permanent damage could be done if the teeth sheared off, the circular plate was damaged, or the motor was damaged. The force of friction between the brake shoes and the circular plate is designed to be less than the force needed to break or damage the circular plate, the sprocket and the motor. In addition, this force can be adjusted by varying the force applied by compression elements 95. A greater frictional force will require a greater load in order to cause the support 40 to move relative to circular member 60, while a lesser force will allow the support 40 to move relative to circular member 60 in response to a lower load. The specific value of the frictional force is determined by balancing the need to maintain the stationary nature of the blade under most conditions with the need to protect the electric motor from damage caused by an unexpected load.

In some implementations, some limited movement of the motor 70 may occur in response to the movement of the blade without damage to the motor 70 or the sprocket 80. In those cases, the frictional force is adjusted to account for this expected, acceptable movement of the motor 70. In all cases, the frictional force is adjusted to insure that the output of motor 70 does not undergo substantial movement, which would cause permanent damage to it. Similarly, the frictional force ensures that sprocket 80 and the circular member 60 are not damaged by the movement of the blade.

Once the support has moved relative to the circular plate 60, the operator can bring the blade back to its desired position by simply adjusting the angle of the blade via a power switch. Since the electrical motor and sprocket have infinite movement in both directions, it is always possible to reposition the blade.

Figure 2:
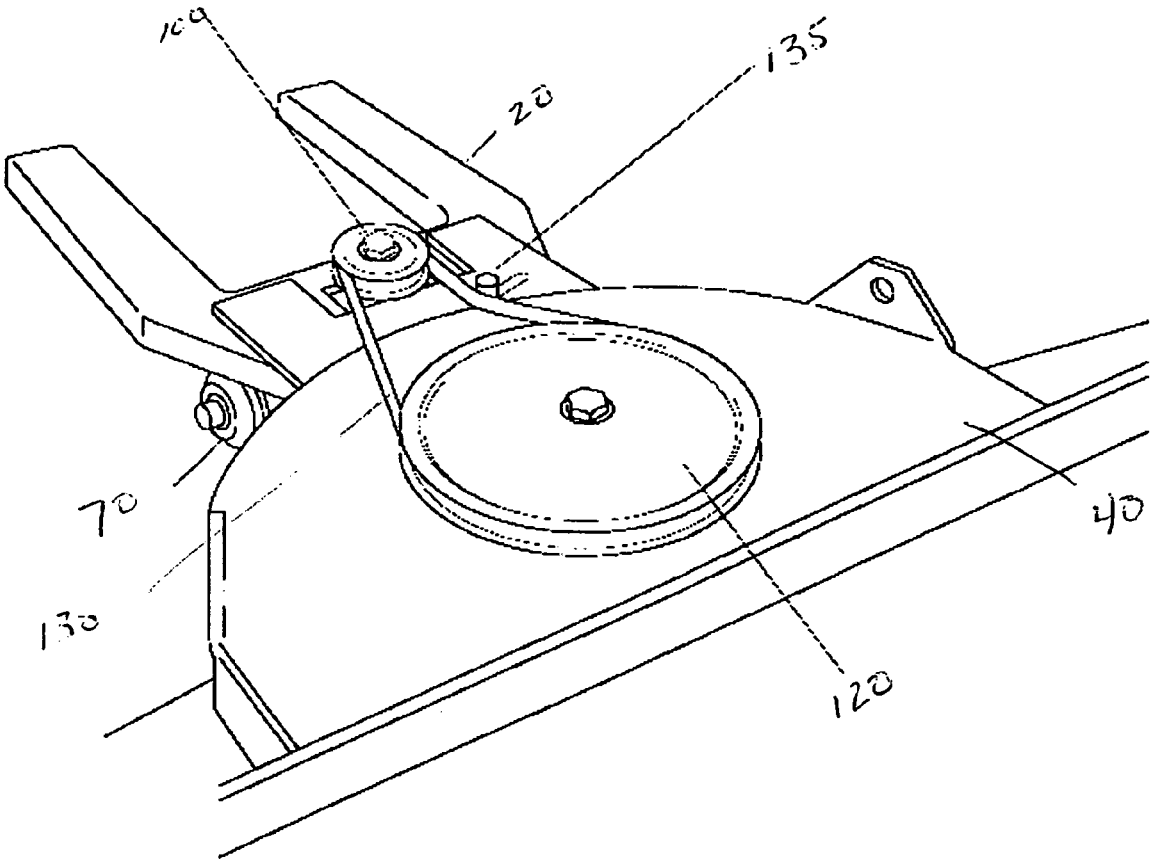
FIG. 2 is a top view of a second embodiment of the electrically powered snow blade in accordance with the present invention.

FIG. 2 shows a second embodiment of the present invention, where all numerals correspond to those elements previously described. A first drive pulley 100 is located on frame 20 and is driven by electric motor 70. First pulley 100 is able to rotate independently of frame 20. A second drive pulley 120 is mounted with its center in alignment with vertical axis 50. Second pulley 120 is fixed to support 40, such that the movement of pulley 120 causes a corresponding movement in support 40, thereby effecting a movement of the plow blade (not shown). A belt 130 is provided between first pulley 100 and second pulley 120 with sufficient tension that movement of the first pulley 100 typically causes a corresponding movement of the second pulley 120. For example, a clockwise rotation of the first pulley 100 will cause a clockwise rotation of the second pulley 120. Under normal conditions, the operator adjusts the blade by signaling the motor to rotate the first pulley in either a clockwise or counterclockwise direction. The belt 130 causes a corresponding movement of second pulley 120, which causes support 40 and plow blade to move accordingly. An idler 135 is used to vary the tension of belt 130. The effect of adjusting the idler is analogous to the adjustment of the frictional force in FIG. 1. As the tension increases, first pulley 100 and second pulley 120 are more tightly linked and will experience less slippage when an excessive load is encountered. Conversely, lower tension allows increased slippage between the pulleys, allowing the blade to move more easily when encountering an excessive load.

Suppose that an unexpected excessive load is encountered at the left edge of the plow blade. If the force exceeds a predetermined value, second pulley 120 will move relative to belt 130 (e.g., the belt "slips" on the pulley 120), thereby absorbing the impact. In this manner, the electrical motor 70 is not subjected to a force that would be likely to damage it.

Figure 3:
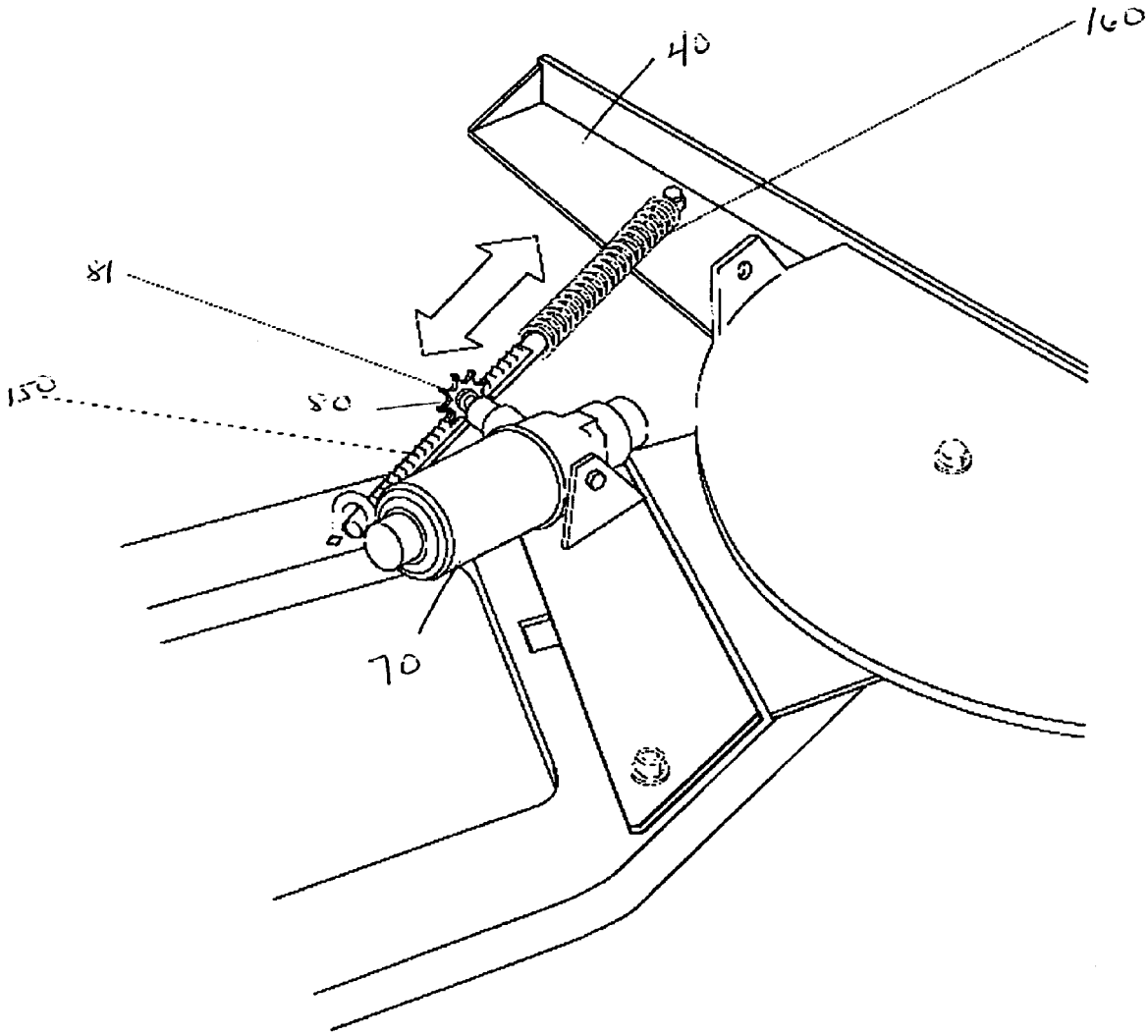
FIG. 3 is a top view of a third embodiment of the electrically powered snow blade in accordance with the present invention.

FIG. 3 shows a third embodiment of the present invention, where all numerals correspond to those elements previously described. Electrical motor 70 drives a shaft that is in communication with sprocket 80. The teeth 81 of sprocket 80 are in communication with one end of rod 150. Rod 150 has features that correspond and interconnect to the teeth 81 of the sprocket. These features can be holes, as was described in reference to FIG. 1, or interlocking teeth, such as in a rack and pinion implementation. Rod 150 includes a portion beyond the pinion that is in communication with support 40, typically near the outer edge of the support. Rod 150 is compressible, and contains a compression element 160, such as a spring. In normal operation, the rotational movement of the sprocket 80 causes a corresponding linear movement of rod 150. This linear movement either draws the end of the support 40 near, or pushes it away, thereby creating the angle of the blade. Electrical motor 70 is designed to have limited movement in the forward and reverse direction, such that the motor can only operate over the portion of the rod 150 where the teeth (pinion) are present.

When the blade encounters an unexpected excessive force, the compression element either expands or compresses in response to the force. Once the force is no longer present, the compression element returns to its normal relaxed position. For example, if an excessive load, such as a curb or rock, is encountered on the left side of the plow, compressible member 160 will compress, thereby allowing the snowplow blade to move in the opposite direction of the load. The plow will stay in this position as long as the force is being exerted on the blade. When the load is no longer present, such as if the vehicle backs away from the curb, the compressible member will relax and return to its normal position. Similarly, if the load is encountered on the right side of the blade, the compressible member 150 will expand in response to the force and remain expanded until the force is removed. The compressible member 150 will then return to its normal position.

Figure 4:
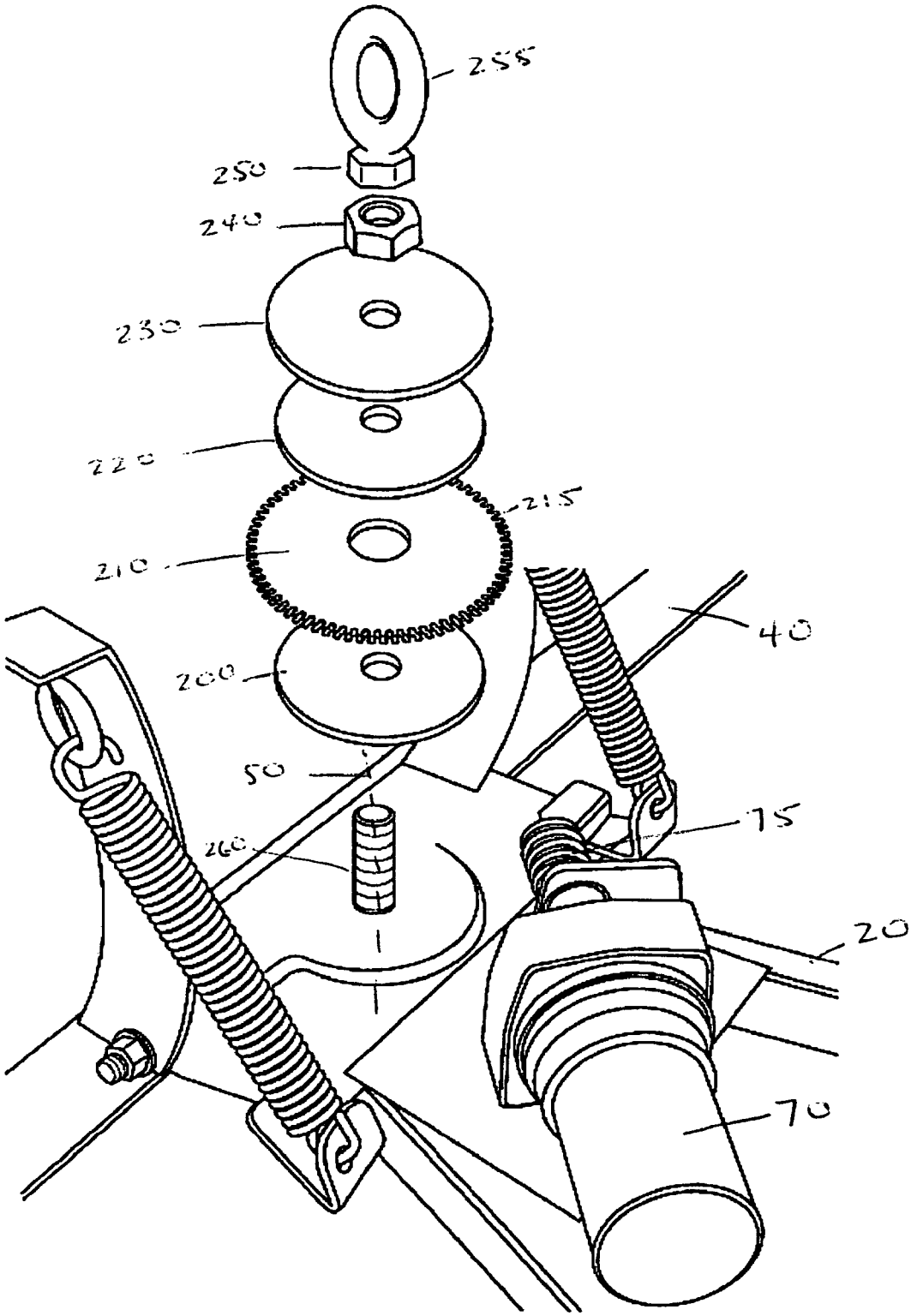
FIG. 4 is an exploded top view of a fourth embodiment of the electrically powered snow blade in accordance with the present invention.
Figure 5:
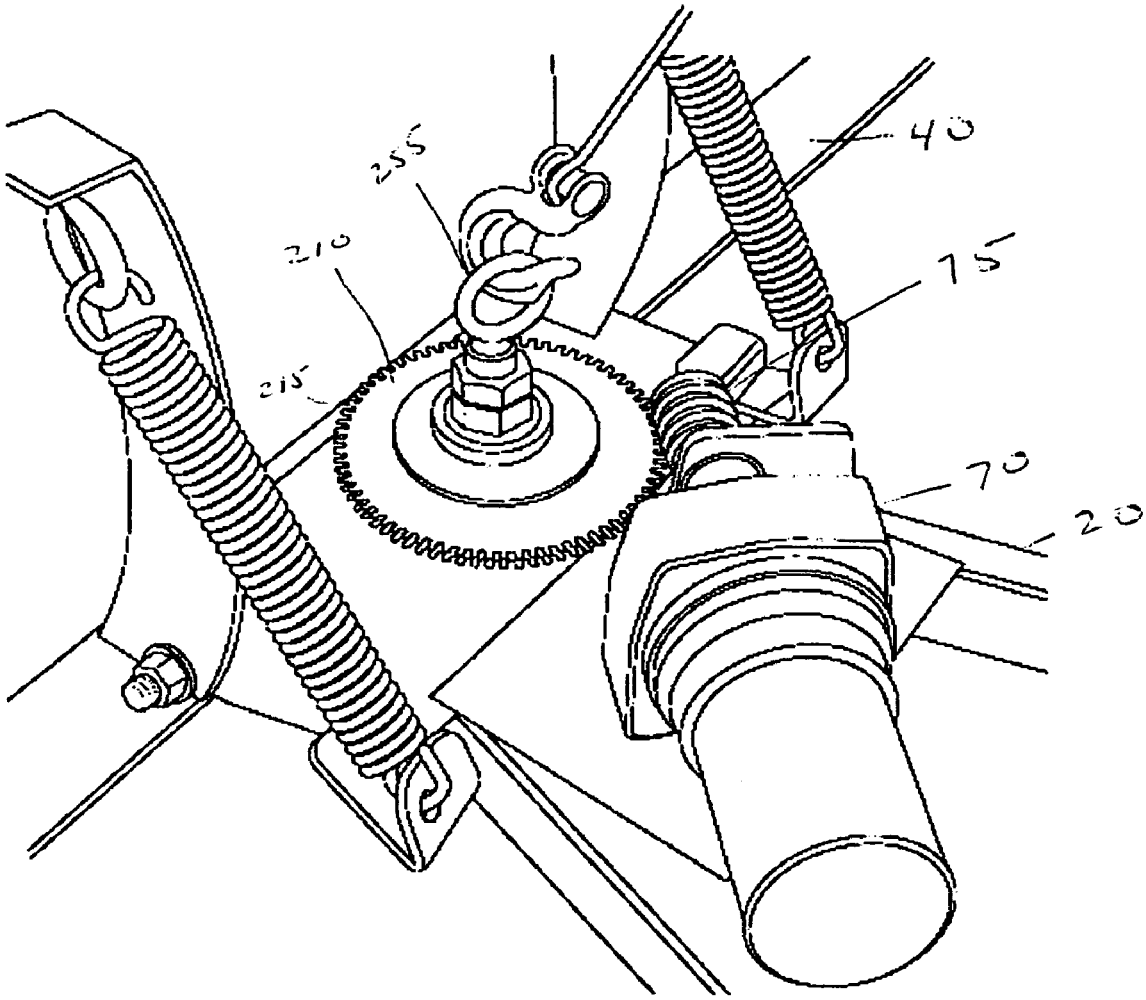
FIG. 5 is a top view of a fourth embodiment of the electrically powered snow blade in accordance with the present invention.

FIGS. 4 and 5 illustrate another embodiment of the present invention. FIG. 4 represents an exploded view of the fourth embodiment. As before, support 40 is pivotally attached to frame 20 through axis 50. Positioning rod 260 is located along axis 50, and pivotally coupled the frame 20 to the support 40. A first frictional plate 200, preferably of rubber, with an opening at its center, is placed atop positioning rod 260. A circular plate 210, preferably with teeth 215 located along its circumference (e.g., a worm wheel), is then placed atop the first frictional plate 200. A second frictional plate 220, preferably of rubber, is placed atop circular plate 210. In the preferred embodiment, frictional plates 200 and 220 are circular, with a diameter less than or equal to that of the circular plate, so as not to interfere with the operation of the teeth 215. A metal plate 230 is placed atop the second frictional plate 220. The metal plate 230 is preferably circular, and has a diameter greater than or equal to that of the second frictional plate 220, but smaller than that of the circular plate 210. The four plates are then secured by placing a fastening device 240 atop positioning rod 260. Positioning rod 260 is preferably threaded, and fastening device 240 is preferably a bolt, which is rotated onto positioning rod 50 to compress the four plates. Lastly, an attachment device 250, such as a loop, is placed atop the fastening device 240. In the preferred embodiment, a cable is secured to the device 250, allowing the entire blade assembly to be lifted.

Electrical motor 70 is in communication with a mechanism which interacts with circular plate 210 to cause its rotation about axis 50. As illustrated in FIG. 1, a sprocket can be used in conjunction with holes on the circular plate. Alternatively, a worm gear 75 can be placed on the motor shaft as shown in FIGS. 4 and 5. In FIG. 5, the grooves on worm gear 75 are spaced so as to correspond to the distance between the teeth 215 on circular plate 210, now acting as a worm wheel, allowing the teeth and grooves to mesh. The rotation of electrical motor 70 causes a corresponding rotation of worm gear 75. This rotation causes the circular plate 210 to rotate about axis 50. The opposite rotation of the electrical motor would cause the circular plate 210 to rotate in the opposite direction.

Fastening device 240 is tightened so as to compress the four plates. In this way, frictional plates 200 and 220 are pressed against circular plate 210. In normal operation, the frictional forces between frictional plate 200, the circular plate 210 and support 40 are sufficiently strong so that the support 40 will move in response to the rotation of circular plate 210. Therefore, when the circular plate is rotated in a clockwise direction, the support 40 will likewise rotate in a clockwise direction, due to the frictional forces between it and the circular plate 210.

The friction between the support 40 and the circular plate 210, is sufficient to hold the circular plate in a fixed position relative to the support under most circumstances. However, if the plow blade encounters an excessive load sufficient to overcome the frictional forces, the support 40 will move relative to the circular plate. This insures that the impact of the excessive load is not transferred back to the nexus of the teeth 215 of the circular plate 210 and the worm gear 75, where permanent damage could be done if the teeth sheared off, the worm gear was damaged, or the motor was damaged. The force of friction between the support and the circular plate is designed to be less than the force needed to break or damage the circular plate, the worm gear and the motor. The frictional force can be adjusted by tightening the fastening device 240. A greater frictional force will require a greater load in order to cause the support 40 to move relative to circular member 210, while a lesser force will allow the support 40 to move relative to circular member 210 in response to a lower load. The specific value of the frictional force is determined by balancing the need to maintain the stationary nature of the blade under most conditions with the need to protect the electric motor from damage caused by an unexpected load.

Figure 6:
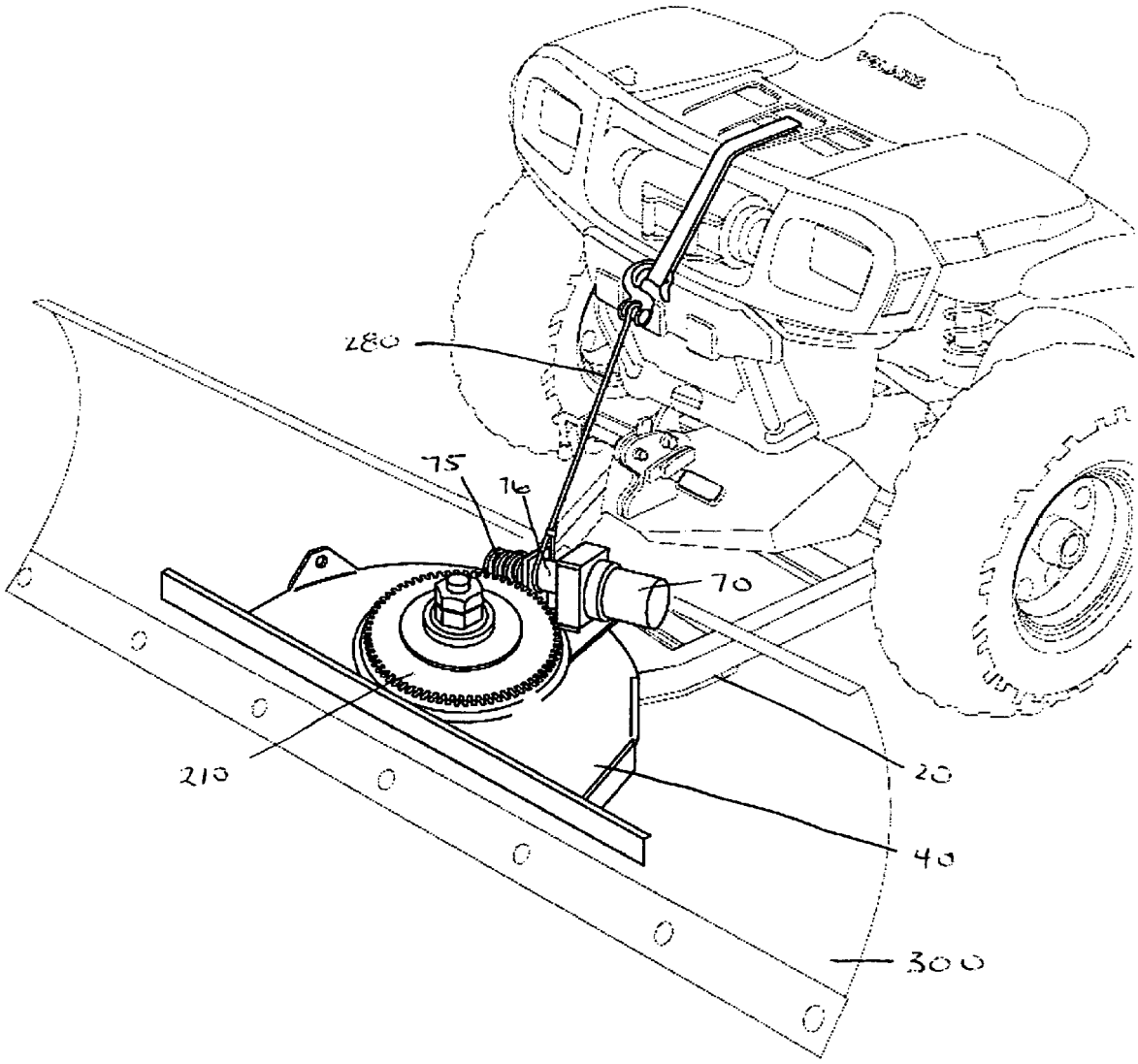
FIG. 6 is a top view of a fourth embodiment of the electrically powered snow blade in accordance with the present invention as used in conjunction with an ATV.

FIG. 6 illustrates the present invention as used in conjunction with a snowplow blade and an ATV vehicle, where all numerals correspond to those elements previously described. As described earlier, support 40 can be an integral part of the blade 300, or can be attached to the blade 300 such as by welding. Support 40 is pivotally attached to frame 20 at point 50, such as to allow support 40 to move rotationally about a vertical axis through point 50. The opposite end of frame 20 is then attached to the vehicle, either directly or using one of many attachment methods. Those skilled in the art are aware of numerous mechanisms which allow the attachment of the frame to the vehicle, including that taught by U.S. Pat. No. 6,594,924, issued to Curtis International.

As previously described, motor 70 is in communication with a shaft which includes a worm gear 75. Shaft segment 76 is located on the shaft between the worm gear 75 and the motor 70. Cable 280 is wound around shaft segment 76, such that the cable can be extended or retracted by the rotation of shaft segment 76. The other end of cable 280 can be attached directly to the vehicle, as shown in FIG. 6. Alternatively, it can be threaded through a pulley and attached to device 255 of FIG. 5, which would reduce the amount of force needed to raise the blade by a factor of 2. Those skilled in the art are aware of several mechanisms which allow the worm gear and the shaft segment to move independently, including the use of a clutch. For example, when the clutch is engaged, rotation of the motor 70 will cause a corresponding rotation of the shaft segment 76. This rotation will cause the cable 280 to be wound around the shaft segment, thereby causing the blade 300 to be lifted. Similarly, rotation in the opposite direction will cause the cable to be unwound from the shaft segment, thereby lowering the bladed 300 to the ground. When this clutch is not engaged, rotation of the motor causes a corresponding rotation of the worm gear, causing the support 40 to rotate about axis 50. In this manner, the same motor 70 can be used to position the blade in the rotational direction, as well as lift the blade from the ground. While the lift mechanism is shown in conjunction with the fourth embodiment, the invention is not so limited. The shaft segment and cable can be used in conjunction with any of the embodiments of the present invention.

Those skilled in the art will appreciate that the present invention is not limited to application to snow plows; other utilitarian accessories such as brushes, sweepers, carts, push bars, hitches, winches, etc. can be used.

What is claimed is:

1. An assembly for mounting to a vehicle, comprising:

a fixed support;

a utilitarian accessory pivotally attached to said fixed support about a vertical axis;

a motor having a rotating output;

a drive system, which converts the rotation of said motor output to a corresponding rotational movement of said utilitarian accessory and allows movement of said accessory about said vertical axis in response to external forces applied to said accessory without substantial movement of said motor output, wherein said drive system comprises:

a circular member, whose center is aligned with said vertical axis, in communication with said motor output such that the rotation of said motor output creates a corresponding rotation of said circular member;

a frictional element rigidly attached to said accessory, in frictional contact with said circular member, such that rotation of said circular member causes a rotation of said accessory, and where said friction can be overcome by said external forces such that in response to said external forces, said accessory rotates without a corresponding rotation of said circular member, and further comprising a biasing member adapted to vary the contact force between said circular member and said frictional element, thereby varying said frictional contact.

2. The assembly of claim 1, wherein said utilitarian accessory is a plow blade.

3. The assembly of claim 1, whereby said motor and said drive system are not damaged by said movement of said accessory in response to said external force.

4. An assembly for mounting to a vehicle, comprising:

a fixed support;

a utilitarian accessory pivotally attached to said fixed support about a vertical axis;

a motor having a rotating output;

a drive system, which converts the rotation of said motor output to a corresponding rotational movement of said utilitarian accessory and allows movement of said accessory about said vertical axis in response to external forces applied to said accessory without substantial movement of said motor output, wherein said drive system comprises:

a circular member, whose center is aligned with said vertical axis, in communication with said motor output such that the rotation of said motor output creates a corresponding rotation of said circular member;

a frictional element in frictional contact with said accessory and said circular member, such that rotation of said circular member causes a rotation of said accessory, and where said friction can be overcome by said external forces such that in response to said external forces, said accessory rotates without a corresponding rotation of said circular member and further comprising a biasing member adapted to vary the contact force between said circular member and said frictional element, thereby varying said frictional contact.

5. The assembly of claim 4, wherein said utilitarian accessory is a plow blade.

6. The assembly of claim 4, whereby said motor and said drive system are not damaged by said movement of said accessory in response to said external force.

* * * * *